US011426019B2

(12) United States Patent
Jenkins

(10) Patent No.: US 11,426,019 B2
(45) Date of Patent: Aug. 30, 2022

(54) SYSTEMS, DEVICES, AND/OR METHODS FOR MANAGING PANTS

(71) Applicant: Gary Jenkins, Luray, VA (US)

(72) Inventor: Gary Jenkins, Luray, VA (US)

( * ) Notice: Subject to any disclaimer, the term of this patent is extended or adjusted under 35 U.S.C. 154(b) by 0 days.

(21) Appl. No.: 17/086,005

(22) Filed: Oct. 30, 2020

(65) Prior Publication Data

US 2021/0127878 A1 May 6, 2021

Related U.S. Application Data

(60) Provisional application No. 62/928,227, filed on Oct. 30, 2019.

(51) Int. Cl.
*A47G 25/48* (2006.01)
*A47G 25/28* (2006.01)

(52) U.S. Cl.
CPC ..... *A47G 25/481* (2013.01); *A47G 25/28* (2013.01)

(58) Field of Classification Search
CPC ..... A47G 25/481; A47G 25/28; A47G 25/34; A47G 25/48; A47G 25/14; A47G 25/20; A47G 25/24; A47G 25/30; A47G 25/36; A47G 25/485; A47G 25/494; A47G 25/487; A47G 25/50
USPC ..... D6/317, 327
See application file for complete search history.

(56) References Cited

U.S. PATENT DOCUMENTS

| | | | | | |
|---|---|---|---|---|---|
| 756,588 | A * | 4/1904 | Coney | A47G 25/481 | 223/96 |
| 1,018,056 | A * | 2/1912 | Hincher | A47G 25/481 | 223/96 |
| 1,157,107 | A * | 10/1915 | Herrmann | A47G 25/481 | 223/96 |
| 2,213,537 | A * | 9/1940 | Stevens | A47G 25/0657 | 211/89.01 |
| 2,413,798 | A * | 1/1947 | Strassburg | A47G 25/28 | 223/96 |
| 2,425,829 | A * | 8/1947 | Rosenberg | A47G 25/28 | 223/88 |
| 2,843,297 | A * | 7/1958 | William | A47G 25/48 | 223/95 |
| D183,640 | S * | 9/1958 | Van Dusen | D6/327 | |
| D190,403 | S * | 5/1961 | Van Dusen | A47G 25/32 | D6/327 |
| 3,061,155 | A * | 10/1962 | Van Dusen | A47G 25/26 | 223/96 |

(Continued)

FOREIGN PATENT DOCUMENTS

| | | | |
|---|---|---|---|
| CH | 252991 | A * | 2/1948 |
| CH | 408341 | A * | 2/1966 |

(Continued)

*Primary Examiner* — Ismael Izaguirre
(74) *Attorney, Agent, or Firm* — Dale Jensen, PLC; Dale Jensen

(57) ABSTRACT

Certain exemplary embodiments can provide a system, which comprises a hanger. The hanger comprises a hook and a bar. The hook is constructed to suspend the hanger from a rod. The bar is coupled to the hook. An end of the bar defines a chevron shape. The bar defines a slot. The slot comprises a seam aperture. The seam aperture is positioned and sized to engage with a plurality of leg seams of a pair of pants to restrain motion of a pair of pants engaged with the hanger.

2 Claims, 4 Drawing Sheets

(56) References Cited

U.S. PATENT DOCUMENTS

| | | | | | |
|---|---|---|---|---|---|
| 3,152,737 | A * | 10/1964 | Cates | A47G 25/481 | 223/96 |
| 3,276,645 | A * | 10/1966 | Buzzelli | A47G 25/24 | 223/95 |
| 3,519,176 | A * | 7/1970 | Sturm | A47G 25/481 | 223/96 |
| 3,524,226 | A * | 8/1970 | Brown | D06F 55/00 | 223/85 |
| 5,083,691 | A * | 1/1992 | Handrick | A47G 25/32 | 223/91 |
| 5,249,719 | A * | 10/1993 | Hulyk | A47G 25/481 | 223/95 |
| 7,237,700 | B2 * | 7/2007 | Bulovic | A47G 25/0657 | 223/85 |
| 2008/0251548 | A1 * | 10/2008 | Mulderig | A47G 25/32 | 223/85 |
| 2015/0351574 | A1 * | 12/2015 | Eslami | A47G 25/54 | 206/388 |

FOREIGN PATENT DOCUMENTS

| | | | |
|---|---|---|---|
| DE | 366932 | C * | 1/1923 |
| DE | 29514493 | U1 * | 11/1995 |

* cited by examiner

SYSTEMS, DEVICES, AND/OR METHODS FOR MANAGING PANTS

CROSS-REFERENCES TO RELATED APPLICATIONS

This application claims priority to, and incorporates by reference herein in its entirety, pending U.S. Provisional Patent Application Ser. No. 62/928,227, filed Oct. 30, 2019

DETAILED DESCRIPTION

Certain exemplary embodiments can provide a system, which comprises a hanger.

The hanger comprises a hook and a bar. The hook is constructed to suspend the hanger from a rod. The bar is coupled to the hook. An end of the bar defines a chevron shape. The bar defines a slot. The slot comprises a seam aperture. The seam aperture is positioned and sized to engage with a plurality of leg seams of a pair of pants to restrain motion of a pair of pants engaged with the hanger.

Figure 1:
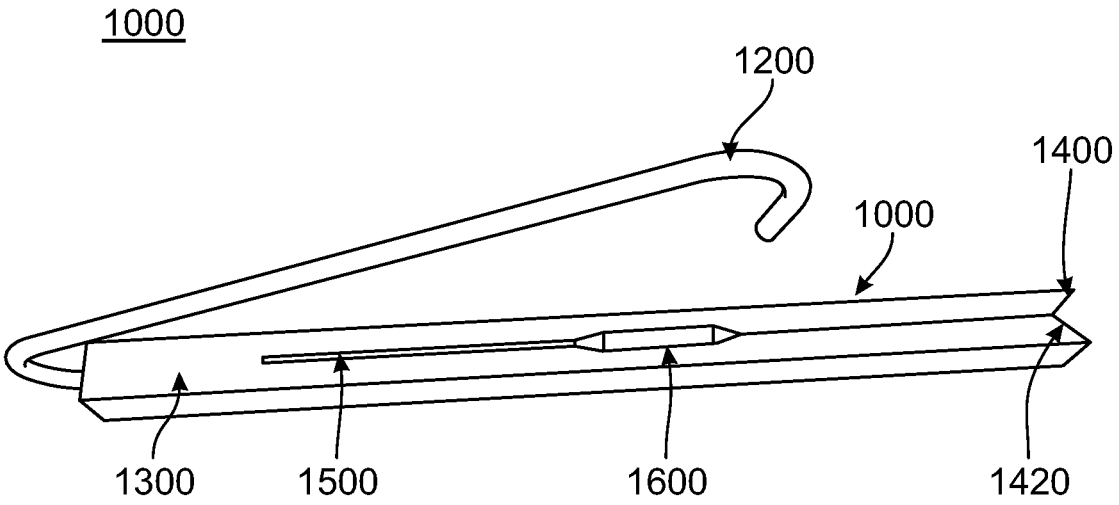
FIG. 1 is a perspective view of an exemplary embodiment of a hanger 1000.

FIG. 1 is a perspective view of an exemplary embodiment of a hanger 1000.

Certain exemplary embodiments provide a hanger 1000 comprising a hook 1200. Hook 1200 is constructed to suspend hanger 1000 from a rod, such as a rod in a clothing closet. Hanger 1000 comprises a bar 1300, which is coupled to hook 1200. An end 1400 of bar 1300 can define a chevron shape 1420. Bar 1300 defines a slot 1500. Slot 1500 comprises a seam aperture 1600. Seam aperture 1600 is positioned and sized to engage with a plurality of leg seams of a pair of pants to restrain motion of a pair of pants engaged with hanger 1000.

In the illustrated embodiment of hanger 1000, hook 1200 is made of a metal material and bar 1300 is made of wood. In such embodiments, pants can be slid into slot 1500 and be hung from the leg cuffs. The presence of slot 1500 in bar 1300 allows limited flexure in bar 1300 as pants are slid into slot 1500 to be hung from hanger 1000. The chevron shape of end 1400 facilitates sliding pant legs into slot 1500 to be hung from hanger 1000.

Certain exemplary embodiments can comprise a plastic or polymer material.

Materials of construction are selected to have sufficient structural strength to support and hang pants from a rod, such as a rod in a clothing closet. Such embodiments can be of a unitary construction such that hook 1200 is integral with bar 1300. When unitary construction is utilized, molds can be used to make hanger 1000. When unitary construction is utilized, the junction between bar 1300 and hook 1200 can be seamless and tapered.

Certain exemplary embodiments are springless (i.e., lacking any spring) in their design. Such embodiments rely on slight amounts of flexure of bar 1300 in portions of bar 1300 that define slot 1500.

Hanger 1000 comprises:

hook 1200 is constructed to suspend hanger 1000 from a rod; and bar 1300 coupled to hook 1200, an end of bar 1300 defines chevron shape 1420; bar 1300 defines slot 1500, slot 1500 comprising seam aperture 1600, seam aperture 1600 is positioned and sized to engage with a plurality of leg seams of a pair of pants to restrain motion of a pair of pants engaged with hanger 1000.

In certain exemplary embodiments, hook 1200 is integral with bar 1300.

Figure 2:
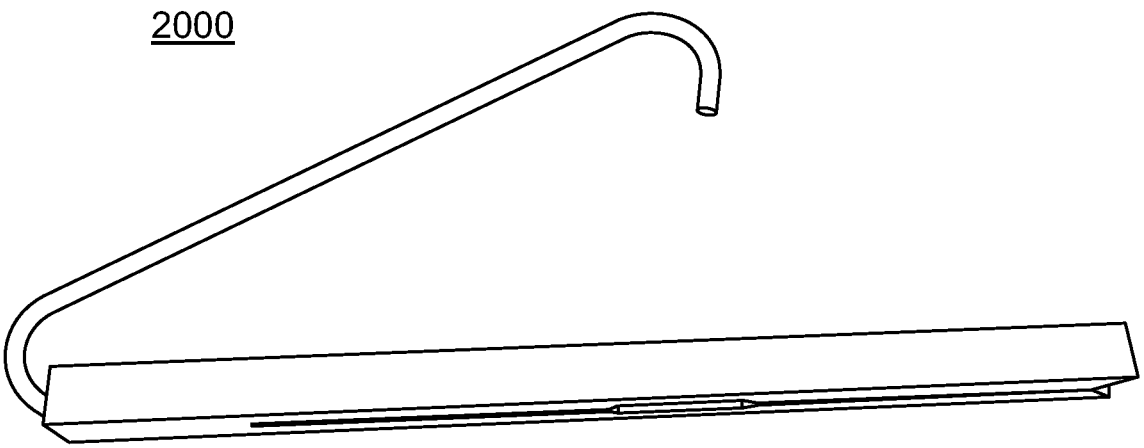
FIG. 2 is a perspective view of exemplary hanger 1000.

FIG. 2 is a perspective view of exemplary hanger 1000.

Figure 3:
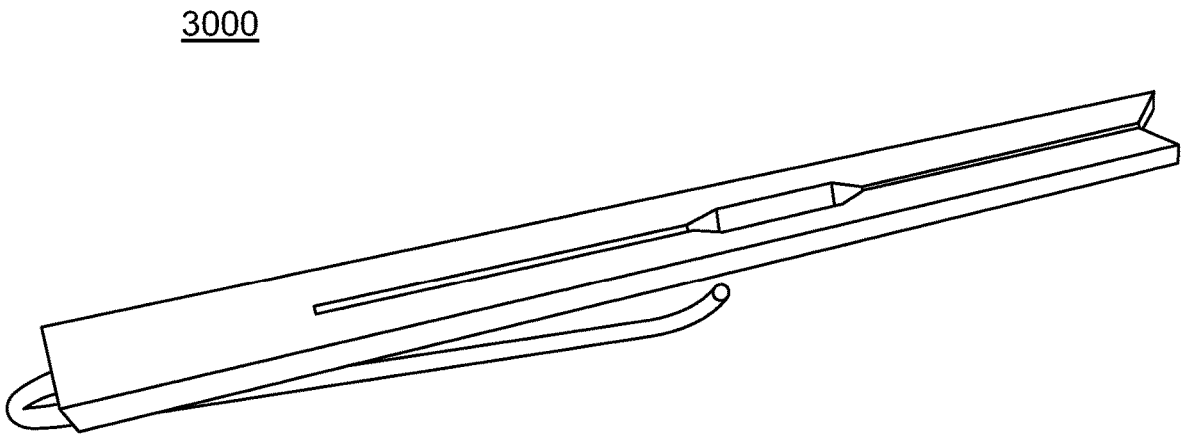
FIG. 3 is a perspective view of exemplary hanger 1000.

FIG. 3 is a perspective view of exemplary hanger 1000.

Figure 4:
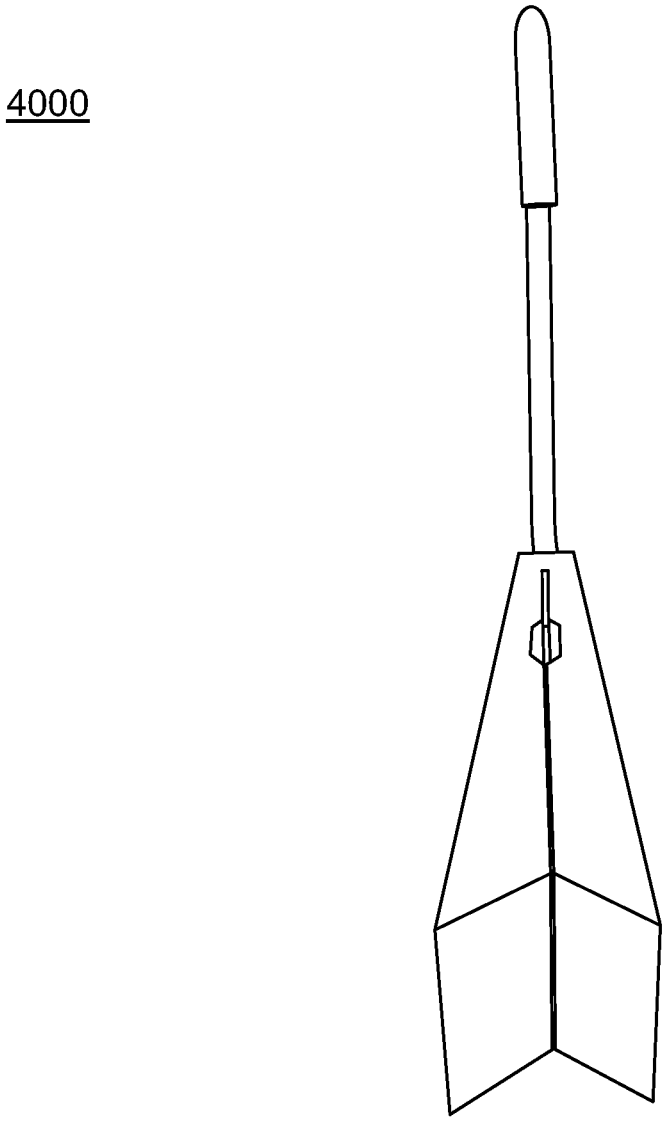
FIG. 4 is a perspective view of exemplary hanger 1000.

FIG. 4 is a perspective view of exemplary hanger 1000.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof.

adapter—a device used to effect operative compatibility between different parts of one or more pieces of an apparatus or system.

and/or—either in conjunction with or in alternative to.

aperture—an opening in something.

apparatus—an appliance or device for a particular purpose. associate—to join, connect together, and/or relate.

bar—a length of material.

can—is capable of, in at least some embodiments.

chevron shape—having a shape of a V or an inverted V.

comprising—including but not limited to.

configure—to make suitable or fit for a specific use or situation.

connect—to join or fasten together.

constructed to—made to and/or designed to.

couple—to join, connect, and/or link together.

define—to establish the outline, form, or structure of device—a machine, manufacture, and/or collection thereof.

and—a most extreme part of an object.

engage—to be in contact and interact with.

hanger—a frame constructed to support a suspended garment.

hook—a peg or protrusion from which something can be hung.

install—to connect or set in position and prepare for use.

integral—formed as a monolithic whole.

may—is allowed and/or permitted to, in at least some embodiments.

method—a process, procedure, and/or collection of related activities for accomplishing something.

motion—a process via which something changes position from one location to another.

pair of pants—trousers.

plurality—the state of being plural and/or more than one.

position—a location.

predetermined—established in advance.

provide—to furnish, supply, give, and/or make available.

receive—to get as a signal, take, acquire, and/or obtain.
repeatedly—again and again; repetitively.
restrain—to limit motion of something.
rod—a thin straight bar.
seam—a sewn section of fabric comprising overlapping layers.
set—a related plurality.
size—how large something is.
slot—a narrow opening or groove.
store—to place, hold, and/or retain.
substantially—to a great extent or degree.
support—to bear the weight of, especially from below.
suspend—to hang something from above.
system—a collection of mechanisms, devices, machines, articles of manufacture, processes, data, and/or instructions, the collection designed to perform one or more specific functions.
via—by way of and/or utilizing.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system consisting of:

a hanger, the hanger lacking any spring, the hanger consisting of:

a hook constructed to suspend the hanger from a rod; and a single bar, the single bar coupled to the hook via a single arm, the single arm coupled to a first end of the single bar, a second end of the single bar defining a chevron shape, the single bar defining a single slot, the single slot extending from the second end of the single bar, the single slot not extending for a full length of the single bar, the hanger lacking any spring, the single bar utilizing flexure to open and receive a pair of pants in the single slot, the single slot comprising a seam aperture, the seam aperture is positioned and sized to engage with a plurality of leg seams of the pair of pants to restrain motion of the pair of pants engaged with the hanger.

2. The system of claim 1, wherein:

the hook is integral with the bar.

* * * * *